US011573035B2

(12) United States Patent
Lee et al.

(10) Patent No.: US 11,573,035 B2
(45) Date of Patent: Feb. 7, 2023

(54) AIR CONDITIONING DEVICE, EJECTOR USED THEREIN, AND METHOD FOR CONTROLLING AIR CONDITIONING DEVICE

(71) Applicant: Samsung Electronics Co., Ltd., Suwon-si (KR)

(72) Inventors: You-seop Lee, Yongin-si (KR); Hee-moon Jeong, Yongin-si (KR); Seong-ho Kil, Seongnam-si (KR); Bo-heum Kim, Suwon-si (KR); Seok-uk Kim, Hwaseong-si (KR); Sun-soo Kim, Suwon-si (KR); Yong-taek Hong, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 458 days.

(21) Appl. No.: 15/763,249

(22) PCT Filed: Apr. 1, 2016

(86) PCT No.: PCT/KR2016/003371
§ 371 (c)(1),
(2) Date: Mar. 26, 2018

(87) PCT Pub. No.: WO2017/065367
PCT Pub. Date: Apr. 20, 2017

(65) Prior Publication Data

US 2018/0274821 A1 Sep. 27, 2018

(30) Foreign Application Priority Data

Oct. 16, 2015 (KR) ..... 10-2015-0144919

(51) Int. Cl.
*F25B 1/06* (2006.01)
*F25B 41/00* (2021.01)
(Continued)

(52) U.S. Cl.
CPC ..... *F25B 41/00* (2013.01); *F25B 1/06* (2013.01); *F25B 41/20* (2021.01); *F25B 49/02* (2013.01);
(Continued)

(58) Field of Classification Search
CPC ..... F25B 1/06; F25B 41/00; F25B 41/20; F25B 49/02; F25B 2341/0013; F25B 2341/0012;
(Continued)

(56) References Cited

U.S. PATENT DOCUMENTS 6,966,199 B2 11/2005 Takeuchi
7,299,645 B2 11/2007 Oshitani et al.
(Continued)

FOREIGN PATENT DOCUMENTS

CN 1470821 1/2004
CN 106574813 4/2017
(Continued)

OTHER PUBLICATIONS

JP-2010151424-A English translation (Year: 2021).*
(Continued)

*Primary Examiner* — Jonathan Bradford
(74) *Attorney, Agent, or Firm* — Staas & Halsey LLP

(57) ABSTRACT

An air conditioning device includes a plurality of ejectors which have a refrigerant circuit including a compressor, a condenser and an evaporator, are connected in parallel to the refrigerant circuit, and are formed so as to each have a different maximum refrigerant flow, and a control unit which, according to a driving condition of the air conditioning device, controls so that the refrigerant flows to one ejector among the plurality of ejectors, and the refrigerant does not flow to the rest of the ejectors.

12 Claims, 17 Drawing Sheets

(51) Int. Cl.
*F25B 49/02* (2006.01)
*F25B 41/20* (2021.01)

(52) U.S. Cl.
CPC ..... *F25B 2341/0012* (2013.01); *F25B 2341/0013* (2013.01); *F25B 2341/0015* (2013.01); *F25B 2400/0407* (2013.01); *F25B 2400/23* (2013.01); *F25B 2600/2507* (2013.01)

(58) Field of Classification Search
CPC ..... F25B 2341/0015; F25B 2400/23; F25B 2400/0407; F25B 2600/2507
See application file for complete search history.

(56) References Cited

U.S. PATENT DOCUMENTS

| | | | | |
|---|---|---|---|---|
| 7,757,514 | B2 | 7/2010 | Oshitani et al. | |
| 10,598,414 | B2 | 3/2020 | Madsen et al. | |
| 2004/0007013 | A1 | 1/2004 | Takeuchi | |
| 2005/0155374 | A1 | 7/2005 | Oshitani et al. | |
| 2013/0000348 | A1* | 1/2013 | Higashiiue | F04F 5/54 62/500 |
| 2014/0345318 | A1* | 11/2014 | Nagano | F25B 41/00 62/500 |
| 2015/0168024 | A1 | 6/2015 | Lee et al. | |
| 2015/0300706 | A1* | 10/2015 | Awa | B60H 1/00921 62/324.6 |
| 2016/0047586 | A1* | 2/2016 | Kayano | F04F 5/10 239/403 |
| 2017/0261245 | A1 | 9/2017 | Madsen et al. | |
| 2018/0119997 | A1* | 5/2018 | Siegert | F25B 9/008 |

FOREIGN PATENT DOCUMENTS

| | | | | | |
|---|---|---|---|---|---|
| JP | 2004-324930 | | | 11/2004 | |
| JP | 2005-76914 | | | 3/2005 | |
| JP | 2005-207648 | A | | 8/2005 | |
| JP | 2007-24412 | | | 2/2007 | |
| JP | 2010-151424 | | | 7/2010 | |
| JP | 2010151424 | A | * | 7/2010 | |
| JP | 4781390 | | | 9/2011 | |
| JP | 4889714 | | | 3/2012 | |
| JP | 2014-77579 | | | 5/2014 | |
| JP | 2014206361 | A | * | 10/2014 | F25B 29/003 |
| KR | 10-2007-0029132 | | | 3/2007 | |
| KR | 10-0801658 | | | 2/2008 | |
| KR | 10-2015-0068710 | A | | 6/2015 | |
| SU | 881471 | | | 11/1981 | |
| WO | 2012/012490 | | | 1/2012 | |
| WO | 2012/074578 | | | 6/2012 | |
| WO | WO-2014156075 | A1 | * | 10/2014 | B05B 1/3489 |

OTHER PUBLICATIONS

Extended European Search Report dated Dec. 6, 2018 in European Patent Application No. 16855585.2.
Partial Supplementary European Search Report dated Sep. 5, 2018 in European Patent Application No. 16855585.2.
International Search Report dated Jul. 15, 2016 in corresponding International Patent Application No. PCT/KR2016/003371.
Written Opinion of the International Searching Authority dated Jul. 15, 2016 in corresponding International Patent Application No. PCT/KR2016/003371.
Korean Office Action for Korean Application No. 10-2015-0144919 dated Jan. 24, 2022.
Korean Office Action for Korean Patent Application No. 10-2015-0144919 dated Jul. 26, 2021.
Chinese Office Action dated Feb. 7, 2020 in Chinese Patent Application No. 201680059703.9.

* cited by examiner

AIR CONDITIONING DEVICE, EJECTOR USED THEREIN, AND METHOD FOR CONTROLLING AIR CONDITIONING DEVICE

CROSS-REFERENCE TO RELATED APPLICATIONS

This application is a National Phase Application under 35 U.S.C. § 371 of PCT International Patent Application No. PCT/KR2016/003371, filed Apr. 1, 2016 which claims the foreign priority benefit under 35 U.S.C. § 119 to Korean Patent Application No. 10-2015-0144919 filed Oct. 16, 2015, the contents of which are incorporated herein by reference.

TECHNICAL FIELD

The present disclosure relates to an air conditioning device, and more particularly, to an air conditioning device using a plurality of ejectors, an ejector used therein, and a method for controlling the air conditioning device.

BACKGROUND ART

Generally, in an air conditioning device, when a refrigerant sequentially passes through a compressor, a condenser, an expansion valve, and an evaporator, a phase of the refrigerant is changed to absorb ambient heat, thereby cooling the surroundings.

In the conventional expansion valve, the expansion loss is generated because the refrigerant loses kinetic energy during the pressure reduction process. However, since the ejector converts the expansion loss generated in the conventional expansion valve into the kinetic energy and uses the kinetic energy to increase the pressure, the compression work is reduced, and thus the energy efficiency of the air conditioning device may be improved.

An example of an air conditioning device using two ejectors is disclosed in Japanese Patent Publication No. 2010-151424 (Invention title: Refrigeration apparatus, filed on Dec. 26, 2008).

In the prior art, two ejectors are used to cope with load fluctuations of the refrigeration apparatus. However, when a large amount of refrigerant is required, the refrigerant flows simultaneously through the two ejectors. Further, in order to control the flow rate of the refrigerant, one of the two ejectors is provided with a needle for controlling the opening degree of the ejector, and the other one of the ejectors has a fixed opening degree for which the opening degree cannot be controlled.

Such a conventional technique has a problem that it is difficult to maximize the pressure increasing effect when supplying the refrigerant to two ejectors because the refrigerant flow rate is increased by simultaneously flowing the refrigerant through the two ejectors. This is because the two ejectors do not have a shape optimized for each refrigerant flow rate.

Therefore, the conventional refrigeration apparatus having two ejectors has a problem that the pressure increasing effect cannot be maximized in the entire range of the refrigerant flow rate when the refrigerant flow rate varies in various ranges according to the load variation.

DISCLOSURE

Technical Problem

The present disclosure has been developed in order to overcome the above drawbacks and other problems associated with the conventional arrangement. An aspect of the present disclosure relates to an air conditioning device that can maximize pressure increasing effect of an ejector in all ranges of a refrigerant flow rate when the refrigerant flow rate fluctuates in a plurality of ranges according to a load variation, and an ejector used therein.

Technical Solution

According to an aspect of the present disclosure, an air conditioning device may include a compressor, a condenser, and an evaporator. The air conditioning device may include a plurality of ejectors connected in parallel to the refrigerant circuit, each of the plurality of ejectors having a different maximum refrigerant flow rate; and a controller configured to control the plurality of ejectors, wherein a refrigerant flows through one of the plurality of ejectors and does not flow through a rest of the plurality of ejectors according to an operation condition of the air conditioning device.

Each of the plurality of ejectors may include an ejector body; a nozzle disposed inside of the ejector body; and an opening degree adjusting device disposed in the nozzle and formed to adjust an opening degree of the nozzle.

The opening degree adjusting device may include a needle that is inserted in the nozzle and adjusts the opening degree of the nozzle, and wherein a plurality of needles disposed in the plurality of ejectors may be operated by one driving part.

The opening degree adjusting device may include a needle guide member, wherein the needle guide member may include a base plate provided at a rear end of the nozzle and a protruding portion protruding from the base plate, and wherein a through hole into which the needle is inserted may be formed at a center of each of the base plate and the protruding portion.

The ejector body may include a main inlet and the nozzle includes a sub-inlet, and wherein the air conditioning device may include a main valve disposed between the condenser and the main inlet and configured to allow a refrigerant to enter the main inlet or to block the refrigerant from entering the main inlet; and a sub valve disposed between the evaporator and the sub-inlet and configured to allow the refrigerant to enter the sub-inlet or to block the refrigerant from entering the sub-inlet.

The main valve may include a three-way valve or a four-way valve.

The sub valve may include a two-way valve, a three-way valve, or a four-way valve.

The nozzle may include a refrigerant passage penetrating in a longitudinal direction; and wherein the refrigerant passage may include a nozzle inlet portion having a cylindrical shape; a shrinkage portion having a truncated conical shape and converging in a moving direction of the refrigerant from the nozzle inlet portion; a nozzle neck connected to the shrinkage portion and having a minimum inner diameter; and a nozzle diffuser portion having a truncated conical shape and diverging from the nozzle neck.

A shrinkage angle of the shrinkage portion may be larger than a diffusion angle of the nozzle diffuser portion.

The diffusion angle of the nozzle diffuser portion may be 0.5 degree to 2 degrees.

An inner diameter of the nozzle inlet portion may be larger than an inner diameter of an outlet end of the nozzle diffuser portion.

A length of the nozzle diffuser portion may be 10 to 50 times the inner diameter of the nozzle neck.

According to another aspect of the present disclosure, an ejector used in an air conditioning device may include an ejector body; a nozzle disposed inside the ejector body; and an opening degree adjusting device disposed in the nozzle and formed to adjust an opening degree of the nozzle, wherein the opening degree adjusting device may include a needle that is inserted in the nozzle and adjusts the opening degree of the nozzle; and a needle guide member configured to support the needle, wherein the needle guide member may include a base plate provided at a rear end of the nozzle and a protruding portion protruding from the base plate, and wherein a through hole into which the needle is inserted may be formed at a center of each of the base plate and the protruding portion.

The needle may be provided with a stopper interfering with the base plate.

According to another aspect of the present disclosure, an ejector used in an air conditioning device may include an ejector body; and a nozzle disposed inside the ejector body; wherein the nozzle may include a refrigerant passage penetrating in a longitudinal direction, wherein the refrigerant passage may include a nozzle inlet portion having a cylindrical shape; a shrinkage portion having a truncated conical shape and converging in a moving direction of the refrigerant from the nozzle inlet portion; a nozzle neck connected to the shrinkage portion and having a minimum inner diameter; and a nozzle diffuser portion having a truncated conical shape and diverging from the nozzle neck, and wherein a shrinkage angle of the shrinkage portion may be larger than a diffusion angle of the nozzle diffuser portion.

According to another aspect of the present disclosure, a method for controlling an air conditioning device provided with a plurality of ejectors may include: identifying which operation mode is selected among a plurality of operation modes of the air conditioning device; and controlling the plurality of ejectors depending on a selected operation mode, wherein a refrigerant flows through one ejector corresponding to the selected operation mode among the plurality of ejectors and the refrigerant does not flow through a rest of the plurality of ejectors.

The method for controlling an air conditioning device may include controlling a flow rate of the refrigerant passing through the selected ejector by adjusting an opening degree adjusting device of the selected ejector.

The controlling the plurality of ejectors depending on a selected operation mode, wherein a refrigerant flows through one ejector corresponding to the selected operation mode among the plurality of ejectors and the refrigerant does not flow through a rest of the plurality of ejectors may be turning on or off valves disposed at a main inlet and a sub-inlet of each of the plurality of ejectors.

BEST MODE

Hereinafter, embodiments of an air conditioning device according to an embodiment of the present disclosure and an ejector used therein will be described in detail with reference to the accompanying drawings.

It is to be understood that the embodiments described below are provided for illustrative purpose only, and that the present disclosure may be embodied with various modifications different form exemplary embodiments described herein. However, in the following description below, detailed description of well-known functions or components will be omitted when it may be unnecessary to obscure the subject matter of the present disclosure. Further, the accompanying drawings may be not drawn to scale in order to facilitate understanding of the invention, but the dimensions of some of the components may be exaggerated.

Figure 1:
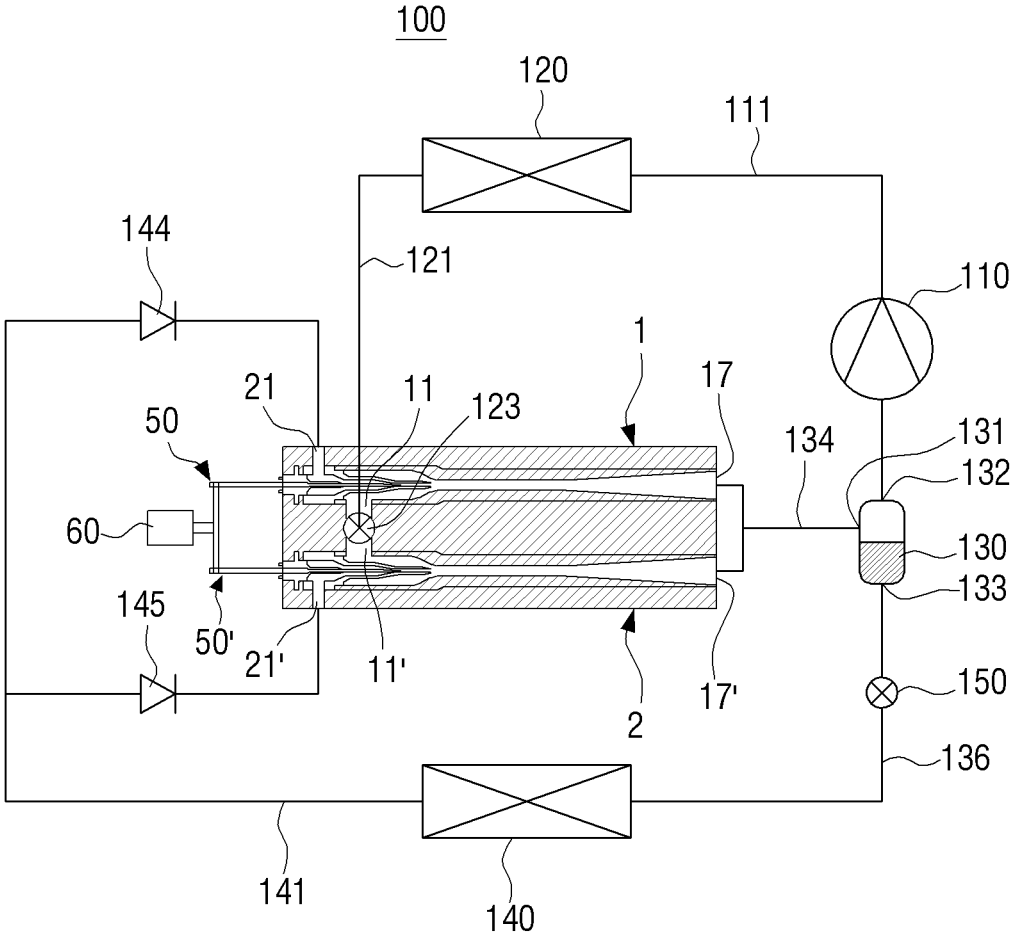
FIG. 1 is a refrigerant circuit diagram of an air conditioning device according to an embodiment of the present disclosure using two ejectors.
Figure 2:
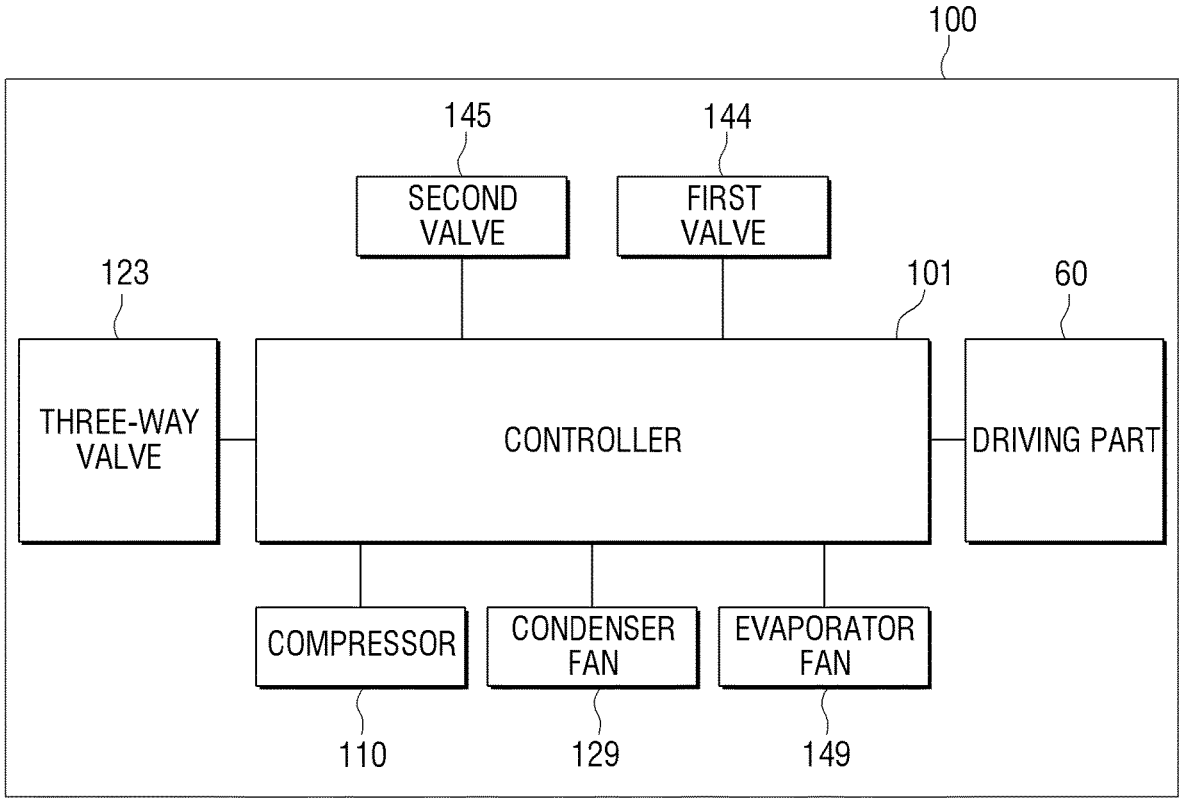
FIG. 2 is a functional block diagram of the air conditioning device of FIG. 1.
Figure 3:
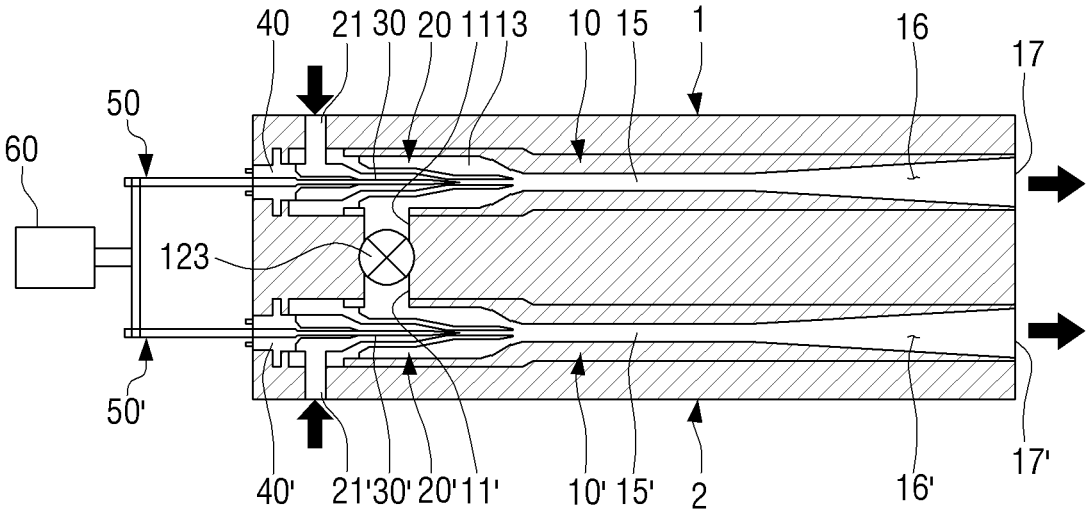
FIG. 3 is a conceptual view illustrating an ejector used in the air conditioning device of FIG. 1.

FIG. 1 is a refrigerant circuit diagram of an air conditioning device according to an embodiment of the present disclosure using two ejectors. FIG. 2 is a functional block diagram of the air conditioning device of FIG. 1. FIG. 3 is a conceptual view illustrating an ejector used in the air conditioning device of FIG. 1.

Referring to FIG. 1, a refrigerant circuit of an air conditioning device 100 according to an embodiment of the present disclosure may include a compressor 110, a condenser 120, two ejectors 1 and 2, a gas-liquid separator 130, and an evaporator 140.

The compressor 110 sucks a refrigerant, pressurizes the refrigerant with high pressure, and discharges the high-pressure refrigerant. The compressor 110 may be a scroll type compressor, a vane type compressor, or the like.

A discharge port of the compressor 110 is connected to a refrigerant inlet of the condenser 120 through a pipe 111. The condenser 120 cools the high-pressure refrigerant discharged from the compressor 110 by a condenser fan 129.

An outlet of the condenser 120 is connected to main inlets 11 and 11' of the two ejectors 1 and 2 via a discharge pipe 121. The two ejectors 1 and 2 are connected in parallel to each other. The two ejectors 1 and 2 are formed so that when the refrigerant flows through one ejector, the refrigerant does not flow through the other ejector. The one ejector through which the refrigerant flows between the two ejectors 1 and 2 is determined according to an operation condition of the air conditioning device 100.

Hereinafter, the two ejectors 1 and 2 are referred to as a first ejector 1 and a second ejector 2, respectively. The first ejector 1 and the second ejector 2 are optimized to different refrigerant flow rate ranges, respectively. Therefore, the first ejector 1 and the second ejector 2 are formed to have different maximum refrigerant flow rates. For example, when the air conditioning device 100 according to an embodiment of the present disclosure is configured to operate in one of a minimum mode, an intermediate mode, and a maximum mode according to the cooling load, the flow rate of the refrigerant flowing through the ejector changes in each mode. When the cooling load increases, the flow rate of the refrigerant flowing through the ejector also increases. Therefore, in the minimum mode, the flow rate of the refrigerant flowing through the ejector is minimized. In the intermediate mode, the flow rate of the refrigerant flowing through the ejector is intermediate. In the maximum mode, the flow rate of the refrigerant flowing through the ejector is maximized. Accordingly, for example, the first ejector 1 may be formed to have an optimal shape for the minimum refrigerant flow rate and the intermediate refrigerant flow rate, and the second ejector 2 may be formed to have an optimal shape for the maximum refrigerant flow rate. The optimum shape of the ejector according to the refrigerant flow rate will be described later.

Both the first ejector 1 and the second ejector 2 are provided with opening degree adjusting devices 50 and 50'. Therefore, the flow rate of the refrigerant passing through the first ejector 1 may be controlled within the range of the minimum refrigerant flow rate and the intermediate refrigerant flow rate by controlling the opening degree adjusting device 50 of the first ejector 1. Further, by controlling the opening degree adjusting device 50' of the second ejector 2, the flow rate of the refrigerant passing through the second ejector 2 may be controlled within the range of the maximum refrigerant flow rate. As illustrated in FIG. 3, the opening degree adjusting device 50 of the first ejector 1 and the opening degree adjusting device 50' of the second ejector 2 may be driven by a single driving part 60. As another example, although not illustrated, the opening degree adjusting device 50 of the first ejector 1 and the opening degree adjusting device 50' of the second ejector 2 may be configured to be operated by separate driving parts. In other words, the two driving parts may be configured to operate the opening degree adjusting device 50 of the first ejector 1 and the opening degree adjusting device 50' of the second ejector 2.

A main valve is provided between the condenser 120 and the first and second ejectors 1 and 2 to select one ejector to which the refrigerant is supplied. In the embodiment as illustrated in FIG. 1, a three-way valve 123 is provided as the main valve. In detail, the three-way valve 123 is connected to the discharge pipe 121 of the condenser 120, and the main inlet 11 of the first ejector 1 and the main inlet 11' of the second ejector 2 are connected to the three-way valve 123 via pipes, respectively.

As illustrated in FIG. 2, the three-way valve 123 is electrically connected to a controller 101 of the air conditioning device 100. The controller 101 is configured to control the main valve, a sub valve, the driving part 60 of the opening degree adjusting device, the compressor 110, the condenser fan 129, and the evaporator fan 149 of the air conditioning device 100. Various operation conditions according to the cooling load may be stored in the controller 101. The controller 101 controls the main valve and the sub-valve according to the operation condition so that the refrigerant flows through only the ejector corresponding to the operation condition among the plurality of ejectors. Therefore, the controller 101 controls the three-way valve 123 as the main valve in accordance with the operation mode of the air conditioning device 100 so that the refrigerant discharged from the condenser 120 may be selectively introduced to one of the first ejector 1 and the second ejector 2.

Discharge ports 17 and 17' of the first and second ejectors 1 and 2 are connected to a refrigerant inlet 131 of the gas-liquid separator 130 through a pipe 134. The gas-liquid separator 130 includes a liquid outlet 133 and a gas outlet 132. The gas outlet 132 of the gas-liquid separator 130 is connected to the refrigerant inlet of the compressor 110 and the liquid outlet 133 is connected to the inlet of the evaporator 140 through a pipe 136.

The liquid refrigerant undergoes heat exchange with the air supplied by the evaporator fan 149 while passing through the evaporator 140, and becomes a gaseous refrigerant. The air cooled in the evaporator 140 is discharged to the outside by the fan to cool the surroundings.

The outlet of the evaporator 140 is connected to the sub-inlets 21 and 21' of the two ejectors 1 and 2 through the pipe 141. A sub-valve capable of selectively introducing the refrigerant coming from the evaporator 140 into one of the first ejector 1 and the second ejector 2 is provided between the evaporator 140 and the two ejectors 1 and 2.

In detail, a first valve 144 is provided between the first ejector 1 and the evaporator 140, and a second valve 145 is provided between the second ejector 2 and the evaporator 140. In this embodiment, when the first valve 144 is turned on, the refrigerant discharged from the evaporator 140 is introduced into the sub-inlet 21 of the first ejector 1, and the second valve 145 is turned off so that the refrigerant discharged from the evaporator 140 is not introduced into the sub-inlet 21' of the second ejector 2. On the contrary, when the second valve 145 is turned on, the refrigerant discharged from the evaporator 140 is introduced into the sub-inlet 21' of the second ejector 2, and the first valve 144 is turned off so that the refrigerant discharged from the evaporator 140 is not introduced into the sub-inlet 21 of the first ejector 1.

In the embodiment as illustrated in FIG. 1, two two-way valves 144 and 145 are used as the sub valves, so that the refrigerant discharged from the evaporator 140 selectively flows into one of the first and second ejectors 1 and 2. As another example, a three-way valve may be used as the sub-valve.

Figure 4:
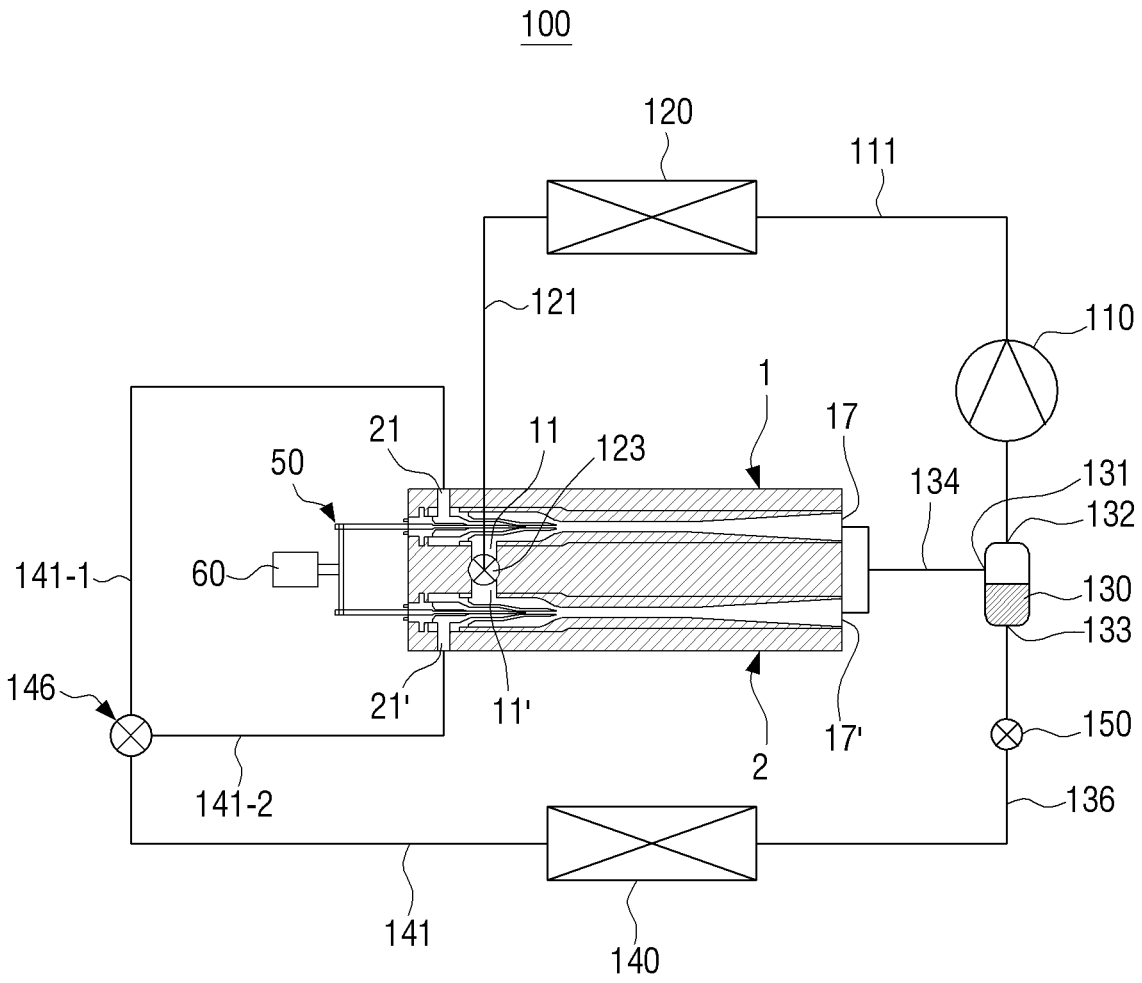
FIG. 4 is a refrigerant circuit diagram illustrating a modified example of the air conditioning device of FIG. 1.

FIG. 4 is a refrigerant circuit diagram illustrating a modified example of the air conditioning device of FIG. 1, in which a three-way valve is used as the sub-valve between the first and second ejectors and the evaporator.

Referring to FIG. 4, a three-way valve 146 is disposed between the evaporator 140 and the first and second ejectors 1 and 2. In detail, the three-way valve 146 is connected to the discharge pipe 141 of the evaporator 140, and the sub-inlet 21 of the first ejector 1 and the sub-inlet 21' of the second ejector 2 are connected to the three-way valve 146 through the branch pipes 141-1 and 141-2, respectively. In this case, the three-way valve 123 connecting the condenser 120 and the main inlets 11 and 11' of the two ejectors 1 and 2 may be referred to as a first three-way valve and the three-way valve 146 connecting the evaporator 140 and the sub-inlets 21 and 21' of the ejectors 1 and 2 may be referred to as a second three-way valve.

Figure 5:
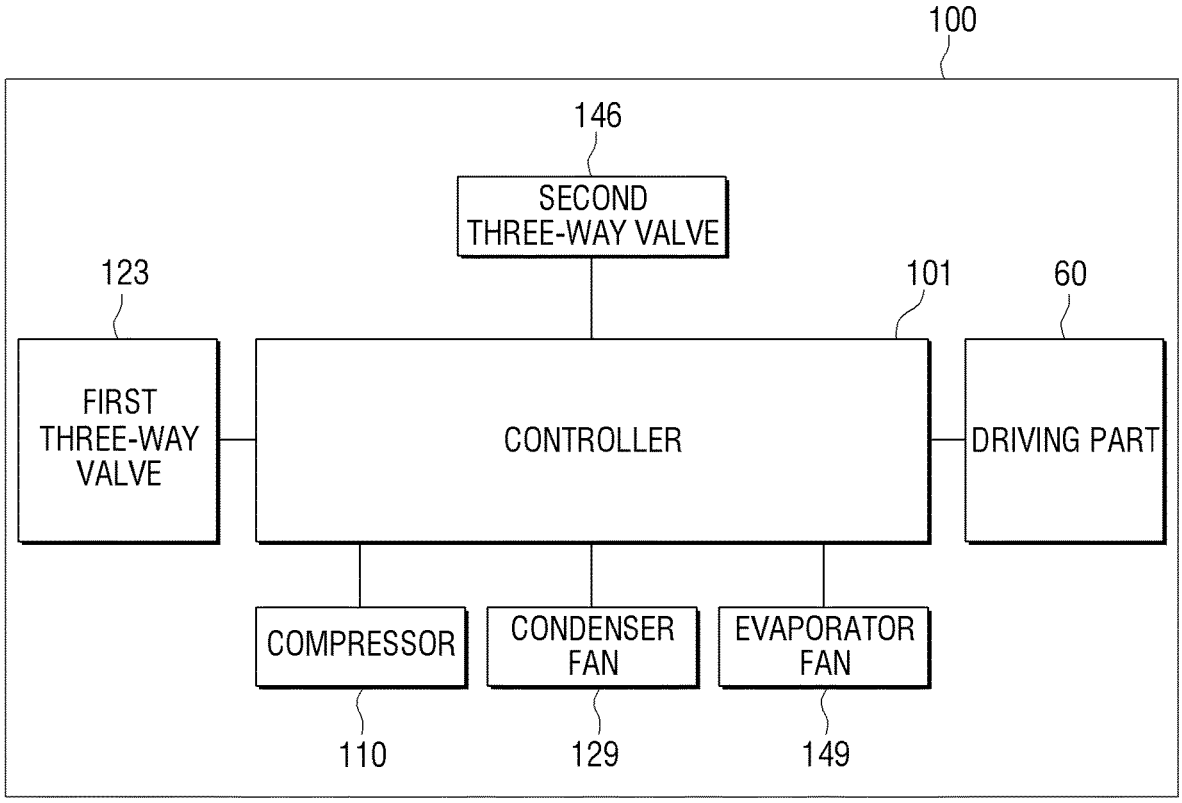
FIG. 5 is a functional block diagram of the air conditioning device of FIG. 4.

As illustrated in FIG. 5, the first three-way valve 123 and the second three-way valve 146 are electrically connected to the controller 101 of the air conditioning device 100. Accordingly, when the controller 101 controls the second three-way valve 146 in accordance with the operation mode of the air conditioning device 100, the refrigerant discharged from the evaporator 140 may be supplied to the sub-inlet 21 or 21' of one of the first ejector 1 and the second ejector 2.

The refrigerant pipes 111 and 121 connecting the main inlets 11 and 11' of the two ejectors 1 and 2 and the gas outlet 132 of the gas-liquid separator 130 through the compressor 110 and the condenser 120 forms a main loop of the refrigeration cycle. Further, the refrigerant pipes 136 and 141 connecting the sub-inlets 21 and 21' of the ejectors 1 and 2 and the liquid outlet 133 of the gas-liquid separator 130 through the evaporator 140 forms an auxiliary loop of the refrigeration cycle.

The air conditioning device 100 according to an embodiment of the present disclosure may be configured to be controlled in three stages depending on the ambient temperature. In other words, the air conditioning device 100 according to an embodiment of the present disclosure may be configured to operate in one among a minimum mode in which it operates at the minimum cooling load, an intermediate mode in which it operates at the intermediate cooling load, and a maximum mode it operates at the maximum cooling load in accordance with the ambient temperature.

For example, when the maximum cooling load is 10 KW, the minimum cooling load may be set to about 3 KW, and the intermediate cooling load may be set to about 7 KW. Therefore, it is necessary to evenly maximize the pressure increasing effect of the ejector in the range of 3 KW to 10 KW in which the cooling load fluctuates. However, in the refrigerant circuit of the air conditioning device, the flow rate of the refrigerant flowing through the ejector increases with an increase in the cooling load. Therefore, when using one ejector having a nozzle capable of controlling the opening degree as in the prior art, it is not easy to obtain a uniform pressure increasing effect over the entire range of the cooling load merely by adjusting the opening degree of the nozzle.

In order to solve such a problem, at least two ejectors 1 and 2 are used according to the cooling load in the present disclosure. The two ejectors 1 and 2 each include an opening degree adjusting device 50 and 50' capable of adjusting the opening degree. At this time, the first ejector 1 may be formed to have an optimum pressure increasing effect in the minimum cooling load and the intermediate cooling load, and the second ejector 2 may be formed to have the optimum pressure increasing effect in the maximum cooling load. As another example, the first ejector 1 may be formed to have the optimum pressure increasing effect only in the minimum cooling load, and the second ejector 2 may be formed to have the optimum pressure increasing effect in the intermediate cooling load and the maximum cooling load.

In the case of the present embodiment, when the maximum cooling load of the air conditioning device 100 is 10 KW, for example, the first ejector 1 is formed to have the optimum pressure increasing effect when the cooling load is in the range of 3 KW to 7 KW, and the second ejector 2 is formed to have the optimum pressure increasing effect when the cooling load is in the range of 7 KW to 10 KW.

Hereinafter, the operation of the air conditioning device 100 according to an embodiment of the present disclosure will be described in detail with reference to FIGS. 1 to 3.

When the air conditioning device 100 is turned on, the high-pressure refrigerant compressed by the compressor 110 is introduced into the condenser 120. The high-pressure refrigerant introduced into the condenser 120 is condensed while radiating heat to the outdoor air. The high-pressure refrigerant flowing out of the condenser 120 flows into the main inlet 11 of the first ejector 1 or the main inlet 11' of the second ejector 2 through the three-way valve 123.

When the air conditioning device 100 operates in the minimum cooling mode or the intermediate cooling mode, the controller 101 controls the three-way valve 123 so that the refrigerant discharged from the condenser 120 flows into the main inlet 11 of the first ejector 1. Further, the controller 101 turns on the first valve 144 so that the evaporator 140 and the sub-inlet 21 of the first ejector 1 are connected to each other and the refrigerant flowing out of the evaporator 140 flows into the first ejector 1. At this time, the second valve 145 connecting the evaporator 140 and the sub-inlet 21' of the second ejector 2 is off, so that the refrigerant flowing out of the evaporator 140 is not introduced into the second ejector 2.

Therefore, the high-pressure refrigerant introduced from the condenser 120 into the main inlet 11 of the first ejector 1 through the three-way valve 123 is depressurized and accelerated. The low-pressure refrigerant discharged from the evaporator 140 is sucked into an ejector body 10 of the first ejector 1 through the sub-inlet 21 of the first ejector 1 by a negative pressure generated by the acceleration of the high-pressure refrigerant.

Accordingly, the accelerated high-pressure refrigerant and the sucked low-pressure refrigerant join together in a mixing portion 15 of the ejector body 10 and are mixed while passing through the mixing portion 15. The mixed refrigerant is decelerated and raised in pressure by a diffuser portion 16 of the ejector body 10, and then is discharged.

The refrigerant discharged from the first ejector 1 flows into the gas-liquid separator 130 through the refrigerant inlet 131. The refrigerant introduced into the gas-liquid separator 130 is separated into a gaseous refrigerant and a liquid refrigerant.

The liquid refrigerant separated in the gas-liquid separator 130 is reduced in pressure while passing the auxiliary expansion valve 150, and then flows into the evaporator 140. The liquid refrigerant introduced into the evaporator 140 take heat from the room air and evaporates. The refrigerant discharged from the evaporator 140 is sucked into the ejector body 10 through the sub-inlet 21 of the first ejector 1 as described above.

On the other hand, the gaseous refrigerant separated in the gas-liquid separator 130 is introduced into the compressor 110 and compressed to a predetermined pressure. The high-pressure refrigerant compressed in the compressor 110 flows into the main inlet 11 of the first ejector 1 through the condenser 120 as described above. The air conditioning device 100 repeats the above-described refrigerant circulation to cool the surrounding air.

When the air conditioning device 100 operates in the maximum cooling mode, the controller 101 controls the three-way valve 123 so that the condenser 120 and the main inlet 11' of the second ejector 2 are connected to each other and the refrigerant flowing out of the condenser 120 is introduced into the second ejector 2. Further, the controller 101 turns on the second valve 145 and turns off the first valve 144 so that the refrigerant discharged from the evaporator 140 is sucked into the sub-inlet 21' of the second ejector 2 through the second valve 145. At this time, the space between the evaporator 140 and the sub-inlet 21 of the first ejector 1 is blocked so that the refrigerant flowing out of the evaporator 140 is not sucked into the first ejector 1.

Therefore, the high-pressure refrigerant introduced into the main inlet 11' of the second ejector 2 through the three-way valve 123 is depressurized and accelerated. The low-pressure refrigerant discharged from the evaporator 140 is sucked into an ejector body 10' of the second ejector 2 through the sub-inlet 21' of the second ejector 2 by a negative pressure generated by the acceleration of the high-pressure refrigerant.

Accordingly, the high-pressure refrigerant and the low-pressure refrigerant introduced into the second ejector 2 are mixed while passing through a mixing portion 15' of the second ejector 2. The mixed refrigerant is decelerated and increased in pressure, and then is discharged through the discharge port 17'.

The refrigerant discharged from the second ejector 2 flows into the gas-liquid separator 130 through the refrigerant inlet 131. The refrigerant introduced into the gas-liquid separator 130 is separated into the gaseous refrigerant and the liquid refrigerant.

The liquid refrigerant separated in the gas-liquid separator 130 is reduced in pressure while passing the auxiliary expansion valve 150, and then flows into the evaporator 140. The liquid refrigerant introduced into the evaporator 140 takes heat from the room air and evaporates. The refrigerant discharged from the evaporator 140 is sucked into the ejector body 10' through the sub-inlet 21' of the second ejector 2 as described above.

On the other hand, the gaseous refrigerant separated in the gas-liquid separator 130 is introduced into the compressor 110 and compressed to the predetermined pressure. The high-pressure refrigerant compressed in the compressor 110 again flows into the second ejector 2 through the condenser 120 and the three-way valve 123 as described above. The air conditioning device 100 repeats the above-described refrigerant circulation to cool the surrounding air.

As described above, in the air conditioning device 100 according to an embodiment of the present disclosure, since the refrigerant flows through one ejector designed optimally to the cooling load between the two ejectors 1 and 2 according to the operation mode, the pressure increasing effect may be maximized in all the operation modes.

In the above description, two ejectors 1 and 2 are used in accordance with the operation condition of the air conditioning device 100. However, when the air conditioning device 100 has three operation conditions, three ejectors may be used.

Figure 6:
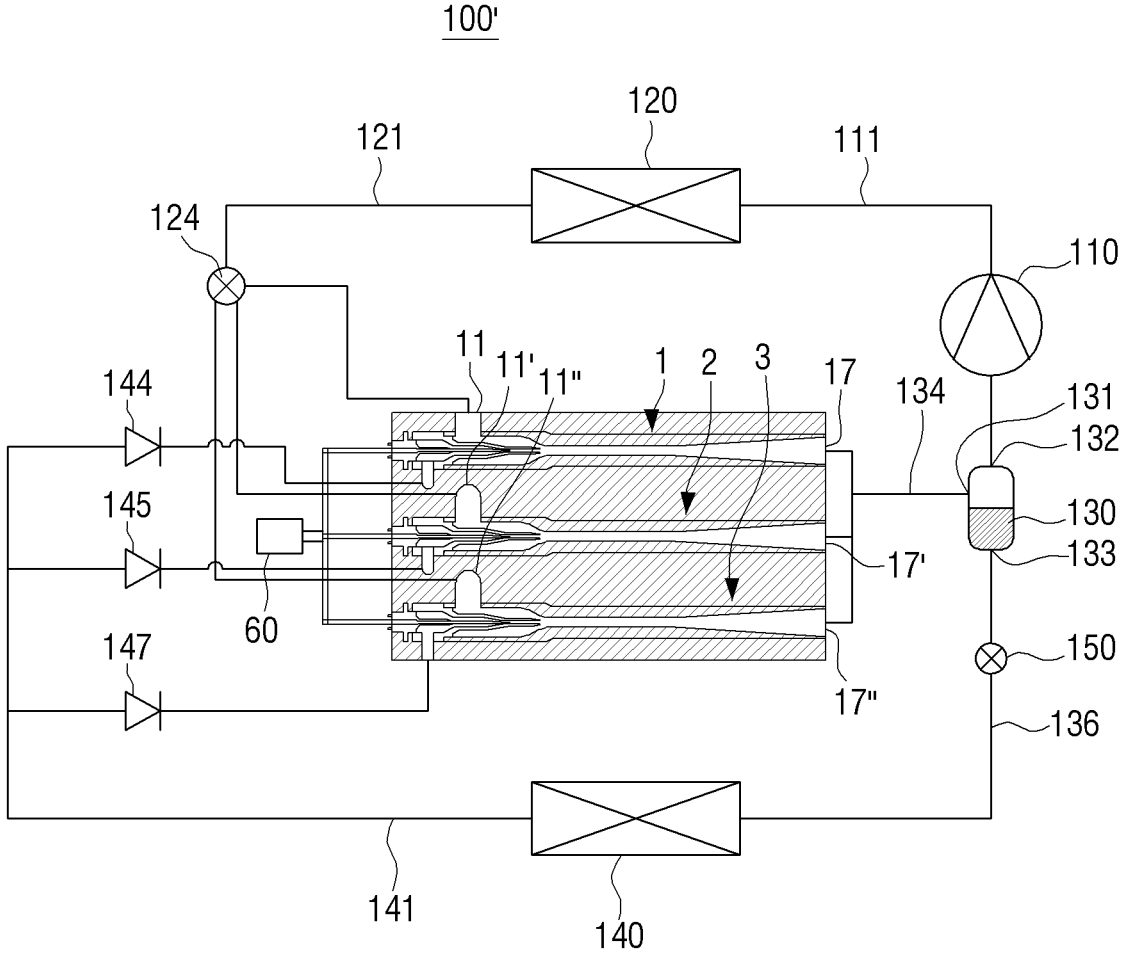
FIG. 6 is a refrigerant circuit diagram of an air conditioning device according to an embodiment of the present disclosure using three ejectors.
Figure 7:
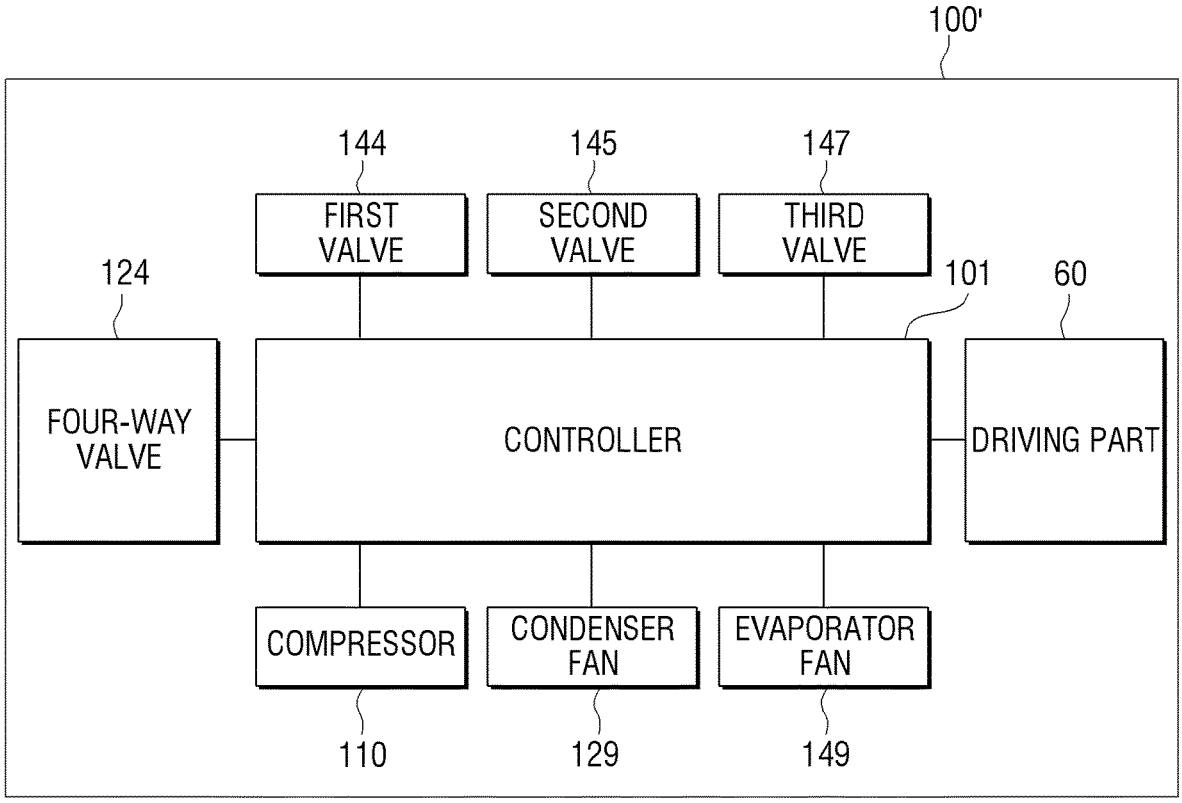
FIG. 7 is a functional block diagram of the air conditioning device of FIG. 6.
Figure 8:
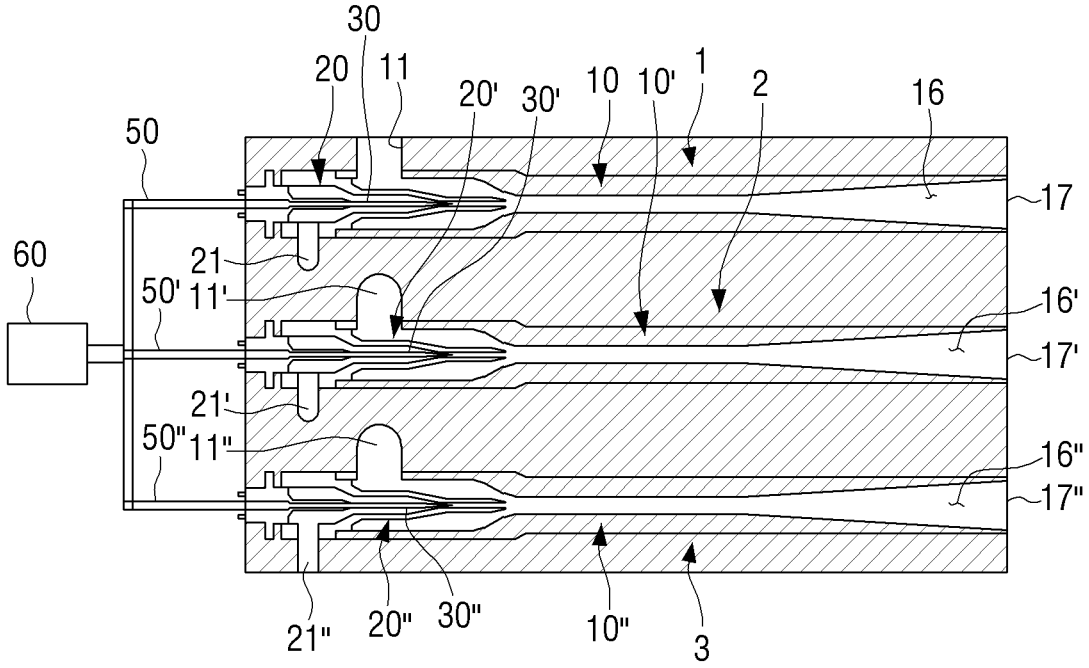
FIG. 8 is a conceptual view illustrating an ejector used in the air conditioning device of FIG. 7.

FIG. 6 is a refrigerant circuit diagram of an air conditioning device according to an embodiment of the present disclosure using three ejectors. FIG. 7 is a functional block diagram of the air conditioning device of FIG. 6. FIG. 8 is a conceptual view illustrating an ejector used in the air conditioning device of FIG. 6.

A refrigerant circuit of an air conditioning device 100' according to an embodiment of the present disclosure may include a compressor 110, a condenser 120, three ejectors 1, 2 and 3, a gas-liquid separator 130, and an evaporator 140.

The compressor 110, the condenser 120, the gas-liquid separator 130, and the evaporator 140 are the same as those of the above-described embodiment, and therefore, detailed descriptions thereof are omitted and only three ejectors 1, 2, and 3 will be described.

The outlet of the condenser 120 is connected to main inlets 11, 11', and 11" of the three ejectors 1, 2, and 3 through the pipe 121. The three ejectors 1, 2, and 3, that is, a first ejector 1, a second ejector 2, and a third ejector 3 are connected in parallel. The three ejectors 1, 2, and 3 are configured so that when the refrigerant flows through one ejector, the refrigerant does not flow through the rest of the ejectors. The one ejector through which the refrigerant flows among the three ejectors 1, 2, and 3 is determined according to the operation condition of the air conditioning device 100.

The first ejector 1, the second ejector 2, and the third ejector 3 are optimized for different refrigerant flow rate ranges, respectively. Therefore, the first ejector 1, the second ejector 2, and the third ejector 3 have different maxim refrigerant flow rates, respectively. For example, when the air conditioning device 100' according to an embodiment of the present disclosure is configured to operate in three operation modes of a minimum mode, an intermediate mode, and a maximum mode, the first ejector 1 may be formed in a shape optimal for the minimum refrigerant flow rate range corresponding to the minimum mode, the second ejector 2 may be formed in a shape optimal for the intermediate refrigerant flow rate range corresponding to the intermediate mode, and the third ejector 3 may be formed in a shape optimal for the maximum refrigerant flow rate range corresponding to the maximum mode.

The first ejector 1, the second ejector 2, and the third ejector 3 all have opening degree adjusting devices 50, 50', and 50". Therefore, by controlling the opening degree adjusting device 50 of the first ejector 1, the flow rate of the refrigerant passing through the first ejector 1 may be controlled within the minimum refrigerant flow rate range. By controlling the opening degree adjusting device 50' of the second ejector 2, the flow rate of the refrigerant passing through the second ejector 2 may be controlled within the intermediate refrigerant flow rate range. Further, by controlling the opening degree adjusting device 50" of the third ejector 3, the flow rate of the refrigerant passing through the third ejector 3 may be controlled within the maximum refrigerant flow rate range.

As illustrated in FIG. 8, the opening degree adjusting device 50 of the first ejector 1, the opening degree adjusting device 50' of the second ejector 2, and the opening degree adjusting device 50" of the third ejector 3 may be driven by one driving part 60. As another example, although not illustrated, the opening degree adjusting device 50 of the first ejector 1, the opening degree adjusting device 50' of the second ejector 2, and the opening degree adjusting device 50" of the third ejector 3 may be configured to be operated by separate driving parts. In other words, three driving parts may be provided for individually controlling the opening degree adjusting device 50 of the first ejector 1, the opening degree adjusting device 50' of the second ejector 2, and the opening degree adjusting device 50" of the third ejector 3.

A four-way valve as a main valve for selecting one of the three ejectors 1, 2, and 3 into which the refrigerant is introduced is provided between the condenser 120 and the first to third ejectors 1, 2, and 3. In detail, a four-way valve 124 is connected to the discharge pipe 121 of the condenser 120. The main inlet 11 of the first ejector 1, the main inlet 11' of the second ejector 2, and the main inlet 11" of the third ejector 3 are connected to the four-way valve 124 through the pipes, respectively.

As illustrated in FIG. 7, the four-way valve 124 is electrically connected to the controller 101 of the air conditioning device 100'. Therefore, when the controller 101 controls the four-way valve 124 in accordance with the operation mode of the air conditioning device 100', the refrigerant discharged from the condenser 120 may be selectively introduced into one ejector among the first ejector 1, the second ejector 2, and the third ejector 3.

The outlet of the evaporator 140 is connected to the sub-inlets 21, 21', and 21" of the three ejectors 1, 2, and 3 through the pipe 141. In detail, a first valve 144 is provided between the first ejector 1 and the evaporator 140, a second valve 145 is provided between the second ejector 2 and the evaporator 140, and a third valve is provided between the third ejector 3 and the evaporator 140. In this embodiment, when the first valve 144 is turned on, the refrigerant discharged from the evaporator 140 is introduced into the sub-inlet 21 of the first ejector 1, and the second valve 145 and the third valve 147 are in the off state so that the refrigerant discharged from the evaporator 140 is not introduced into the sub-inlets 21' and 21" of the second ejector 2 and the third ejector 3. When the second valve 145 is turned on, the refrigerant discharged from the evaporator 140 is introduced into the sub-inlet 21' of the second ejector 2, and the first valve 144 and the third valve 147 are in the off state so that the refrigerant discharged from the evaporator 140 is not introduced into the sub-inlets 21 and 21" of the first ejector 1 and the third ejector 3. Further, when the third valve 147 is turned on, the refrigerant discharged from the evaporator 140 is introduced into the sub-inlet 21" of the third ejector 3, and the first valve 144 and the second valve 145 are in the off state so that the refrigerant discharged from the evaporator 140 is not introduced into the sub-inlets 21 and 21' of the first ejector 1 and the second ejector 2.

In the embodiment as illustrated in FIG. 6, three two-way valves 144, 145 and 147 are used as sub valves so that the refrigerant discharged from the evaporator 140 is selectively introduced into one of the first ejector 1, the second ejector 2, and the third ejector 3. However, although not illustrated, the evaporator 140 and the sub-inlets 21, 21', and 21" of the three ejectors 1, 2, and 3 may be connected to each other by using a four-way valve as the sub-valve.

The discharge ports 17, 17', and 17" of the first to third ejectors 1, 2, and 3 are connected to the refrigerant inlet 131 of the gas-liquid separator 130 through the pipe 134.

The controller 101 of the air conditioning device 100' having the above-described configuration controls the four-way valve 124 connecting the condenser 120 and the main inlets 11, 11', and 11" of the three ejectors 1, 2, and 3 and the first to third valves 144, 145, and 147 connecting the evaporator 140 and the sub-inlets 21, 21' and 21" of the three ejectors 1, 2, and 3 in accordance with the selected operation mode so that the refrigerant flows through only one ejector suitable for the operation mode among the three ejectors 1, 2, and 3. The method by which the controller 101 controls the air conditioning device 100' is similar to the above-described embodiment; therefore, a detailed description thereof is omitted.

As described above, in the air conditioning device 100' according to an embodiment of the present disclosure, since the refrigerant flows through one ejector designed optimally to the cooling load of the operation mode among the three ejectors 1, 2, and 3 according to the operation mode, the pressure increasing effect may be maximized in all the operation modes.

In the above description, the air conditioning device uses two or three ejectors. However, when the air conditioning device has four or more operation modes, the refrigerant circuit may be configured to include four or more ejectors.

In the above description, the refrigerant circuit uses the gas-liquid separator 130. However, an air conditioning device according to another embodiment of the present disclosure may not include the gas-liquid separator. Hereinafter, an air conditioning device including a refrigerant circuit not including a gas-liquid separator will be described with reference to FIG. 9 attached hereto. Here, FIG. 9 is a refrigerant circuit diagram of an air conditioning device according to another embodiment of the present disclosure using two ejectors.

Figure 9:
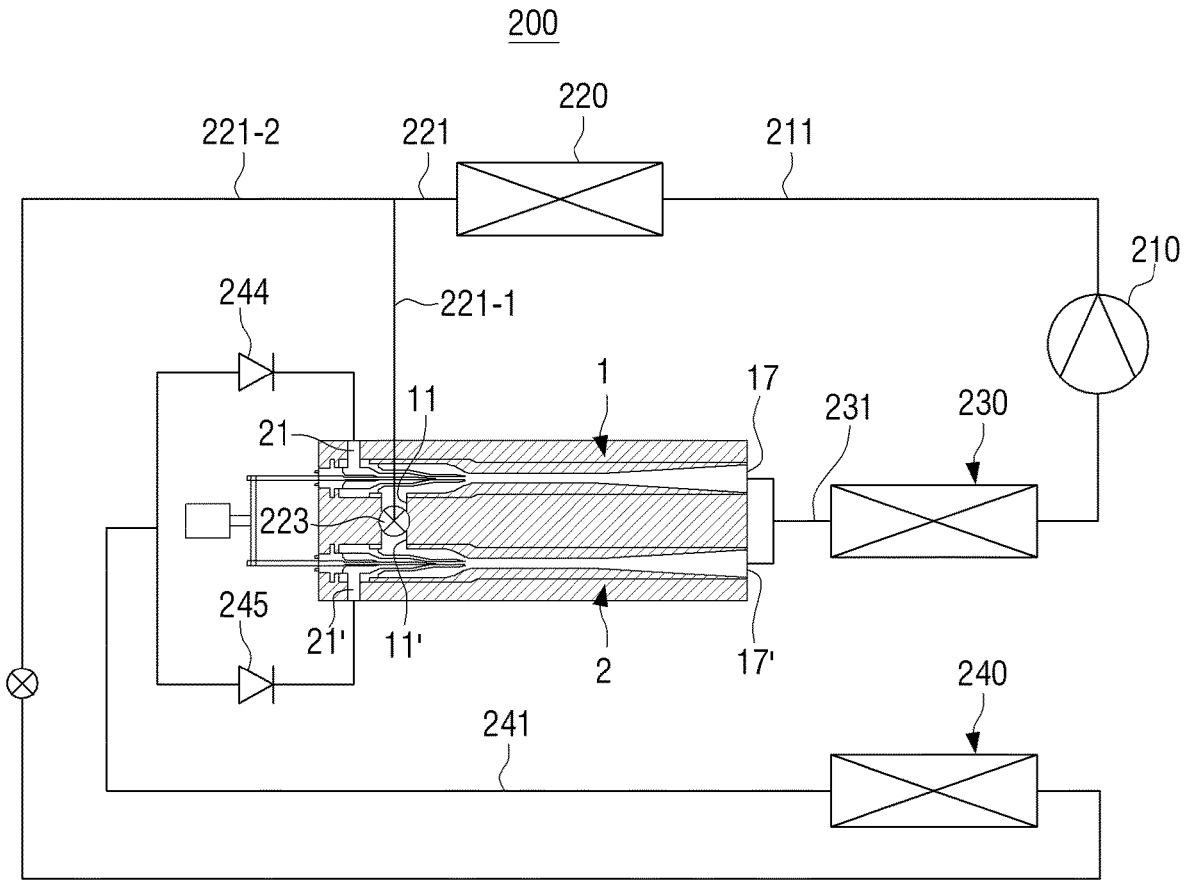
FIG. 9 is a refrigerant circuit diagram of an air conditioning device according to another embodiment of the present disclosure using two ejectors.

Referring to FIG. 9, a refrigerant circuit of an air conditioning device 200 according to an embodiment of the present disclosure may include a compressor 210, a condenser 220, two ejectors 1, and 2, a first evaporator 240, and a second evaporator 230.

The compressor 210 sucks a refrigerant, pressurizes the refrigerant with high pressure, and discharges the high-pressure refrigerant. A scroll type compressor, a vane type compressor, or the like may be used as the compressor 210.

A discharge port of the compressor 210 is connected to a refrigerant inlet of the condenser 220 through a pipe 211. The condenser 220 cools the high-pressure refrigerant discharged from the compressor 210 by a cooling fan.

An outlet of the condenser 220 is connected to the two ejectors 1 and 2 and the first evaporator 240 via a branched discharge pipe 221.

A first branch pipe 221-1 of the discharge pipe 221 is connected to main inlets 11 and 11' of the two ejectors 1 and 2. The two ejectors 1 and 2 are connected in parallel to each other. The two ejectors 1 and 2 are formed so that when the refrigerant flows through one ejector, the refrigerant does not flow through the other ejector. One of the two ejectors 1 and 2 through which the refrigerant flows is determined according to the operation condition of the air conditioning device 200.

Hereinafter, the two ejectors 1 and 2 are referred to as a first ejector 1 and a second ejector 2, respectively. The first ejector 1 and the second ejector 2 are optimized to different refrigerant flow rate ranges corresponding to the operation conditions of the air conditioning device 200. The first and second ejectors 1 and 2 are the same as or similar to the first and second ejectors 1 and 2 of the air conditioning device 100 according to the above-described embodiment; therefore, the detailed descriptions thereof are omitted.

A three-way valve is provided as a main valve between the condenser 220 and the main inlets 11 and 11' of the first and second ejectors 1 and 2. In detail, the three-way valve 223 is connected to the first branch pipe 221-1 of the condenser 220, and the main inlet 11 of the first ejector 1 and the main inlet 11' of the second ejector 2 are connected to the three-way valve 123 through pipes, respectively.

The three-way valve 223 is electrically connected to a controller (not illustrated) of the air conditioning device 200. Therefore, the controller controls the three-way valve 223 in accordance with the operation mode of the air conditioning device 200 so that the refrigerant discharged from the condenser 220 may be selectively introduced into one of the first ejector 1 and the second ejector 2.

Discharge ports 17 and 17' of the first and second ejectors 1 and 2 are connected to an inlet of the second evaporator 230 through a pipe 231. The liquid refrigerant undergoes heat exchange with the air supplied by the fan while passing through the second evaporator 230, and thus becomes a gaseous refrigerant. The air cooled in the second evaporator 230 is discharged to the outside by the fan, and cools the surroundings. The gaseous refrigerant discharged from the second evaporator 230 is introduced into the compressor 210.

Further, the liquid refrigerant discharged from the condenser 220 is introduced into the inlet of the first evaporator 240 through the second branch pipe 221-2 of the discharge pipe 221.

The liquid refrigerant undergoes heat exchange with the air supplied by the fan while passing through the first evaporator 240, and thus becomes a gaseous refrigerant. The air cooled in the first evaporator 240 is discharged to the outside by the fan, and cools the surroundings.

The outlet of the first evaporator 240 is connected to sub-inlets 21 and 21' of the two ejectors 1 and 2 through the pipe 241. In detail, a first valve 244 is provided between the first ejector 1 and the first evaporator 240, and a second valve 245 is provided between the second ejector 2 and the first evaporator 240. In this embodiment, when the first valve 244 is turned on, the refrigerant discharged from the first evaporator 240 is introduced into the sub-inlet 21 of the first ejector 1, and the second valve 145 is in an off state so that the refrigerant discharged from the first evaporator 240 is not introduced into the sub-inlet 21' of the second ejector 2. On the contrary, when the second valve 245 is turned on, the refrigerant discharged from the first evaporator 240 is introduced into the sub-inlet 21' of the second ejector 2, and the first valve 244 is in the off state so that the refrigerant discharged from the first evaporator 240 is not introduced into the sub-inlet 21 of the first ejector 1.

In the embodiment as illustrated in FIG. 9, two two-way valves are used as sub valves, so that the refrigerant discharged from the first evaporator 240 selectively flows into one of the first and second ejectors 1 and 2. However, as another example, a three-way valve may be used as the sub-valve as illustrated in FIG. 4.

Hereinafter, an ejector used in the above-described air conditioning device will be described in detail with reference to FIGS. 10 to 13.

Figure 10:
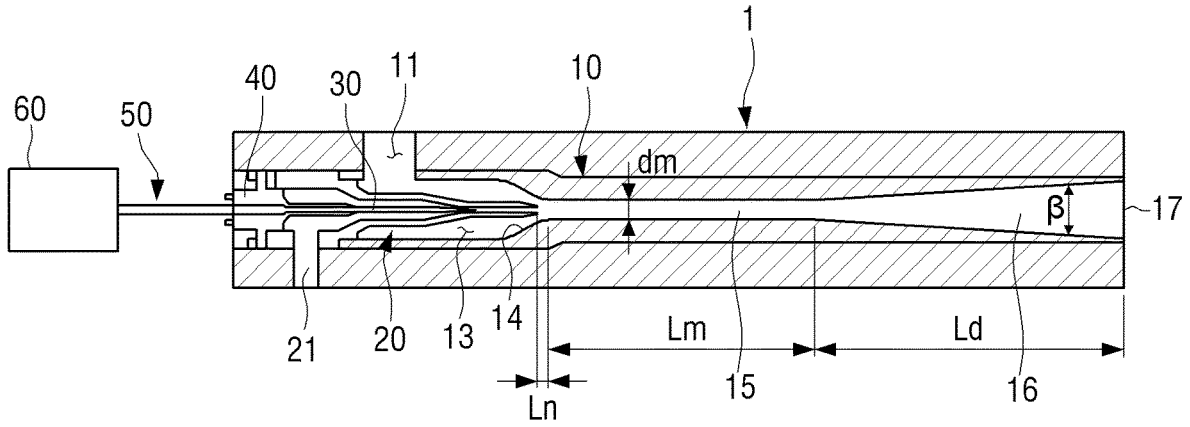
FIG. 10 is a cross-sectional view illustrating an ejector used in an air conditioning device according to an embodiment of the present disclosure.
Figure 11:
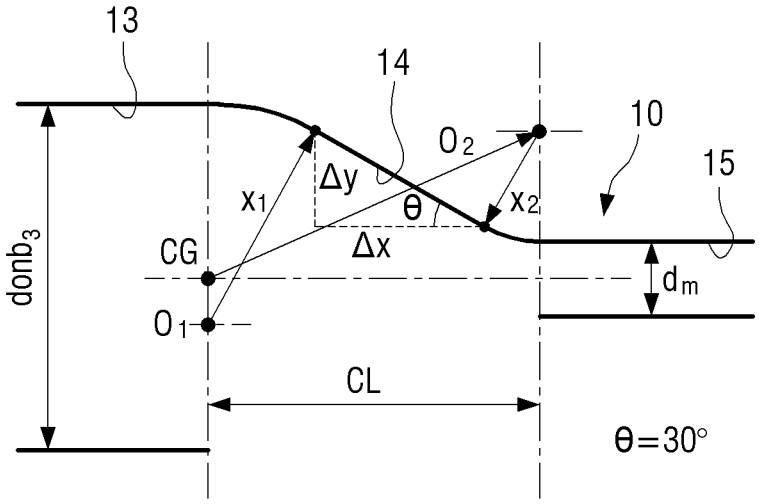
FIG. 11 is a view for explaining a shape of a leading end of an inlet portion connected to a mixing portion of an ejector body of FIG. 10.
Figure 12:
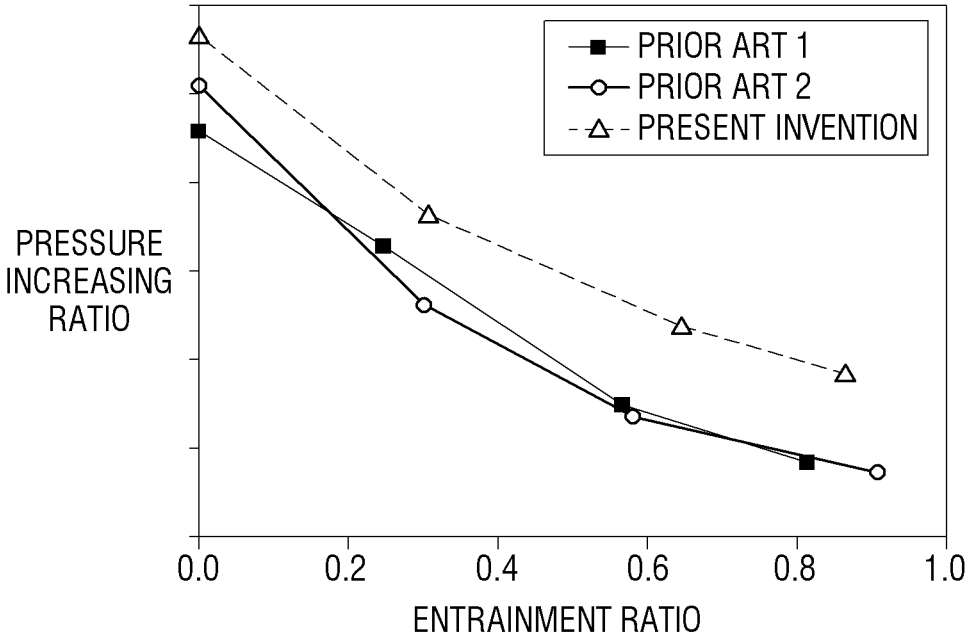
FIG. 12 is a graph illustrating a test result of a pressure increasing ratio with respect to a shape of a leading end of an inlet portion of an ejector body in an ejector according to an embodiment of the present disclosure.
Figure 13:
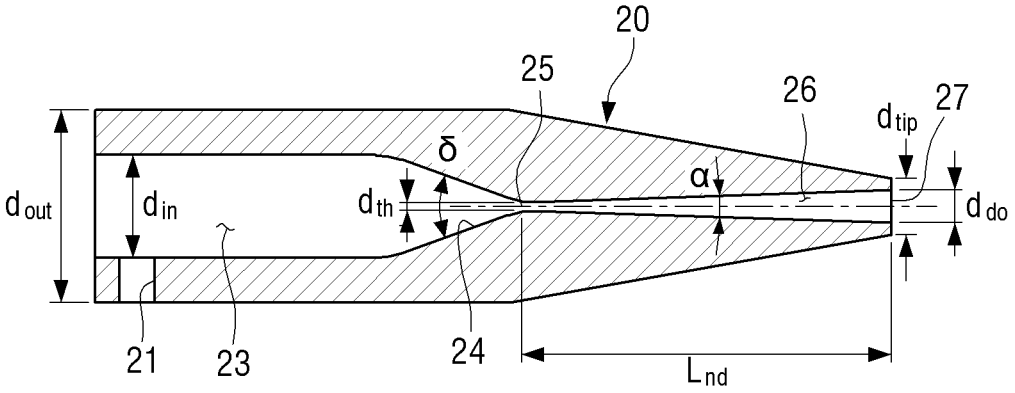
FIG. 13 is a cross-sectional view illustrating a nozzle of the ejector of FIG. 10.
Figure 14:
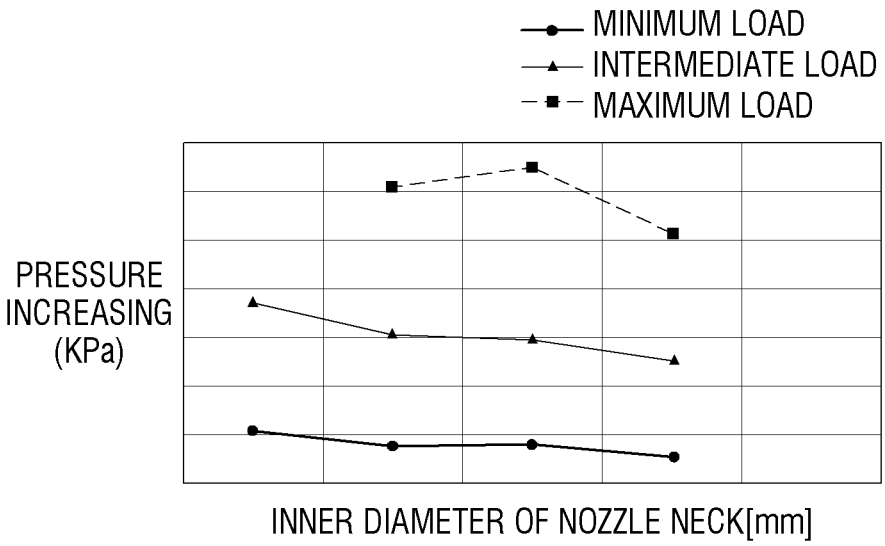
FIG. 14 is a cross-sectional view illustrating a needle guide member provided in a nozzle of the ejector of FIG. 10.

FIG. 10 is a cross-sectional view illustrating an ejector used in an air conditioning device according to an embodiment of the present disclosure. FIG. 11 is a view for explaining a shape of a leading end portion of an inlet portion connected to a mixing portion of an ejector body of FIG. 10. FIG. 12 is a graph illustrating a test result of a pressure increasing ratio with respect to a shape of a leading end of an inlet portion of an ejector body in an ejector according to an embodiment of the present disclosure. FIG. 13 is a cross-sectional view illustrating a nozzle of the ejector of FIG. 10, and FIG. 14 is a cross-sectional view illustrating a needle guide member provided in a nozzle of the ejector of FIG. 10.

The ejector 1 illustrated in FIG. 10 is used in the air conditioning device 100, 100', and 200 according to the above-described embodiments. When two ejectors are used, two ejectors 1 illustrated in FIG. 10 may be used. When three ejectors are used, three ejectors 1 illustrated in FIG. 10 may be used. Although not illustrated, the ejector 1 of FIG. 10 may also be used in an air conditioning device using one ejector.

Referring to FIG. 10, the ejector 1 may include an ejector body 10, a nozzle 20 provided inside the ejector body 10, and an opening degree adjusting device 50 for adjusting the opening degree of the nozzle 20.

The ejector body 10 includes an inlet portion 13, a mixing portion 15, and a diffuser 16 sequentially in the longitudinal direction thereof.

The inlet portion 13 is connected to the main inlet 11 through which the refrigerant discharged from the condenser 120 is introduced. The main inlet 11 is formed on the side surface of the ejector body 10 and spaced apart from the nozzle 20.

The inlet portion 13 may be formed so that the refrigerant introduced into the main inlet 11 passes through before moving to the mixing portion 15. The inlet portion 13 is formed as a cylindrical space and an inner diameter $donb_3$ of the inlet portion 13 is larger than the maximum outer diameter $d_{out}$ of the nozzle 20. A leading end portion 14 of the inlet portion 13 connected to the mixing portion 15 is formed in a truncated conical shape converging in the moving direction of the refrigerant. The leading end portion 14 of the inlet portion 13 forms an inlet of the mixing portion 15. In order to improve the performance of the ejector 1, the inner surface of the leading end portion 14 of the inlet portion 13 may be formed in a continuous curved surface satisfying the following conditions.

In other words, when the inner surface of the leading end portion 14 of the inlet portion 13 is cut along the central axis as illustrated in FIG. 11, the outline of the leading end portion 14 may be formed to satisfy the following conditions.

$$x_1=(3d_m \sin\theta, 3d_m \cos\theta)$$

$$x_2=(-1.5d_m \sin\theta, -1.5d_m \cos\theta)$$

$$O_1=(0, 0.5donb_3-3d_m)$$

$$O_2=(CL, 2d_m)$$

$$CL=3d_m \sin\theta+\Delta x+1.5d_m \sin\theta$$

$$\Delta x=\Delta y/\tan\theta$$

$$\Delta y=(O_1+x_1)y-(O_2+x_2)y=0.5donb_3-5d_m+4.5d_m \cos\theta$$

Here, $d_m$ is the inner diameter (mm) of the mixing portion 15 of the ejector body 10, $donb_3$ is the inner diameter (mm) of the inlet portion 13 of the ejector body 10, and θ is the inclination angle of the leading end portion 14 of the inlet portion 13. FIG. 11 shows a case where θ is 30 degrees.

When the leading end portion 14 of the inlet portion 13 is formed to satisfy the above-described conditions, the suction refrigerant is smoothly sucked into the mixing portion 15 so that the suction loss of the suction refrigerant may be reduced. Therefore, the pressure increasing ratio of the ejector 1 is increased. It can be seen from the graph of FIG. 12 that the pressure increasing ratio of the ejector 1 according to an embodiment of the present disclosure is higher than the pressure increasing ratio of the conventional ejector. Here, FIG. 12 is a graph illustrating a test result of the pressure increasing ratio with respect to a shape of the leading end portion of the inlet portion connected to the mixing portion of the ejector body in the ejector according to an embodiment of the present disclosure.

The mixing portion 15 is formed in a cylindrical shape having a predetermined length where the refrigerant introduced through the main inlet 11 and the refrigerant introduced through the sub-inlet 21 are mixed. Therefore, the refrigerant introduced through the main inlet 11 and the refrigerant introduced through the sub-inlet 21 are mixed with each other while passing through the mixing portion 15, and become a mixed refrigerant.

The diffuser 16 functions as a pressure increasing section that increases the pressure of the mixed refrigerant by reducing the speed of the mixed refrigerant which is mixed while passing through the mixing portion 15. The diffuser 16 is formed in the shape of a truncated cone whose diameter gradually increases toward the discharge port 17. In other words, the diffuser 16 is formed in a shape that is divergent toward the discharge port 17.

The discharge port 17 is connected to a pipe connected to the refrigerant inlet 131 of the gas-liquid separator 130 (see FIG. 1). Accordingly, the mixed refrigerant which is decreased in speed and increased in pressure while passing through the diffuser 16 is discharged to the gas-liquid separator 130 through the discharge port 17.

The nozzle 20 is disposed inside the inlet portion 13 of the ejector body 10, is connected to the sub-inlet 21, and forms a refrigerant passage through which the refrigerant flowing out of the evaporator 140 (see FIG. 1) is sucked. Referring to FIG. 13, the refrigerant passage inside the nozzle 20 includes a nozzle inlet portion 23, a shrinkage portion 24, a nozzle neck 25, and a nozzle diffuser portion 26.

The nozzle inlet portion 23 is formed in a cylindrical shape having a predetermined inner diameter $d_{in}$ and is connected to the sub-inlet 21 so that the refrigerant discharged from the evaporator 140 (see FIG. 1) is introduced into the nozzle inlet portion 23 through the sub-inlet 21.

The shrinkage portion 24 is provided at the leading end of the nozzle inlet portion 23 and is formed in a substantially truncated conical shape converging in the moving direction of the refrigerant.

The nozzle neck 25 is a place where the shrinkage portion 24 and the nozzle diffuser portion 26 meet and is formed to have the minimum inner diameter $d_{th}$ in the refrigerant passage formed inside the nozzle 20.

The nozzle diffuser portion 26 is formed in a substantially truncated conical shape which is diverged in the moving direction of the refrigerant.

Therefore, the refrigerant introduced into the sub-inlet 21 of the nozzle 20 passes through the nozzle inlet portion 23, the shrinkage portion 24, the nozzle neck 25, and the nozzle diffuser portion 26 in order, and then enters the entrance of the mixing portion 15 of the ejector body 10.

In order to improve the performance of the ejector 1, the efficiency of the nozzle 20 needs to be maximized. In order to maximize the efficiency of the nozzle 20, the nozzle 20 may have a specific shape. To maximize the nozzle efficiency means to maximize the speed of the refrigerant passing through the nozzle 20. In the ejector 1 according to an embodiment of the present disclosure, when the liquid refrigerant passes through the nozzle neck 25, a phase change occurs, the speed is reduced due to friction loss or peeling between the interface and the fluid molecules according to the nozzle diffusion angle α, and there is an optimum nozzle diffusion angle α that can minimize the speed reduction. Therefore, the optimum shape condition of the nozzle 20 used in the ejector 1 according to an embodiment of the present disclosure is as follows.

1) The shrinkage angle δ of the shrinkage portion 24 in which the refrigerant passage converges is larger than the diffusion angle α of the nozzle diffuser portion 26 in which the refrigerant passage is diverged.
2) The pressure drop of the ejector 1 is determined by the inner diameter $d_{th}$ of the nozzle neck 25 and the nozzle efficiency is determined by the diffusion angle α of the nozzle 20. The diffusion angle α is in the range of about 0.5 to 2 degrees.
3) The inner diameter $d_{in}$ of the nozzle entrance, that is, the nozzle inlet portion 23, is larger than the inner diameter $d_{do}$ of the nozzle outlet end 27.
4) The length $L_{nd}$ of the nozzle diffuser portion 26 is 10 to 50 times larger than the inner diameter $d_{th}$ of the nozzle neck 25.

In addition, the pressure increasing characteristics of the nozzle 20 vary according to the inner diameter $d_{th}$ of the nozzle neck 25. FIG. 14 is a graph illustrating test results of pressure increasing characteristics of a nozzle neck according to variation of a load condition by an inner diameter of the nozzle neck in an air conditioning device according to an embodiment of the present disclosure. Referring to FIG. 14, it can be seen that the inner diameter $d_{th}$ of the nozzle neck 25 of the nozzle 20 exhibiting the maximum pressure increasing characteristic under the maximum load condition deteriorates the pressure increasing characteristics under the minimum load condition and the intermediate load condition. Therefore, that the refrigerant is allowed to pass through the ejector 1 having a small inner diameter $d_{th}$ of the nozzle neck 25 under the low load condition of the minimum load condition and the intermedium load condition and the refrigerant is allowed to pass through the ejector 2 having a larger inner diameter $d_{th}$ of the nozzle neck 25 under the high load condition may be effective for improving the pressure increasing efficiency. Accordingly, when a plurality of ejectors 1 and 2 are used as in the air conditioning device 100 according to an embodiment of the present disclosure, in the case of the low load, the refrigerant may be allowed to pass through the ejector 1 having a small inner diameter $d_{th}$ of the nozzle neck 25, and in the case of the high load, the refrigerant may be allowed to pass through the ejector 2 having a large inner diameter $d_{th}$ of the nozzle neck 25.

On the other hand, in order to maximize the performance of the ejector 1 according to an embodiment of the present disclosure having the above-described structure, the ejector 1 may be formed to have a specific shape.

The main factors influencing the pressure increase of the ejector 1 are found to be the diffusion angle α of the nozzle diffuser portion 26, the length $L_{nd}$ of the nozzle diffuser portion 26, the length Ld of the diffuser 16 of the ejector body 10, the inner diameter $d_{th}$ of the nozzle neck 25, the inner diameter dm of the mixing portion 15 of the ejector body 10, and the length Lm of the mixing portion 15 through the experiment.

In addition, in the ejector 1 according to an embodiment of the present disclosure, the pressure increase of the ejector 1 may be maximized when the inner diameter dm and length Lm of the mixing portion 15, the length Ld and the diffusion angle β of the diffuser 16, the angle θ of the leading end portion 14 of the inlet portion 13 and a position of the nozzle 20 have the following dimensional relationships.

$$d_m/d_{tip}=1.2\sim3 \quad 1)$$

$$Lm/d_m=4.5\sim38 \quad 2)$$

$$Ld/d_m=75\sim31 \quad 3)$$

$$Ln/d_m=0.2\sim2.5 \quad 4)$$

$$\theta=20^\circ\sim60^\circ \quad 5)$$

$$\beta=4^\circ\sim10^\circ \quad 6)$$

Here, dm is the inner diameter of the mixing portion 15 of the ejector body 10, $d_{tip}$ is the outer diameter of the leading end of the nozzle 20, Lm is the length of the mixing portion 15 of the ejector body 10, Ld is the length of the diffuser 16 of the ejector body 10, Ln is a distance between the leading end of the nozzle 20 and the entrance of the mixing portion 15 of the ejector body 10, θ is the inclination angle of the leading end portion 14 of the inlet portion 13 of the ejector body 10, and β is the diffusion angle of the diffuser 16 of the ejector body 10.

Figure 15:
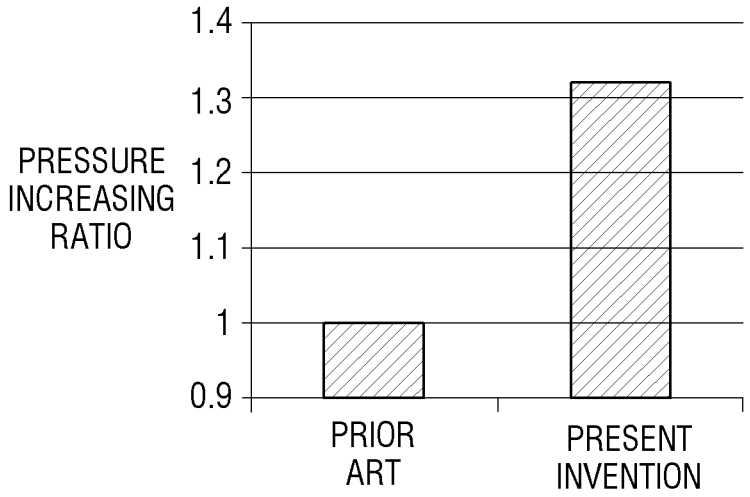
FIG. 15 is a graph illustrating a pressure increasing effect in comparison with a conventional ejector when an ejector according to an embodiment of the present disclosure has an optimal shape.

As can be seen from FIG. 15, the ejector 1 according to an embodiment of the present disclosure having the above-described optimized shape has a pressure increasing ratio of about 1.32, which is about 30% higher than the pressure increasing ratio of the conventional ejector. Here, FIG. 15 is a graph illustrating a pressure increasing effect in comparison with a conventional ejector when an ejector according to an embodiment of the present disclosure has an optimal shape.

On the other hand, the ejector according to the present disclosure may include an opening degree adjusting device capable of adjusting the opening degree of the nozzle to adjust the amount of refrigerant sucked through the nozzle.

Figure 16:
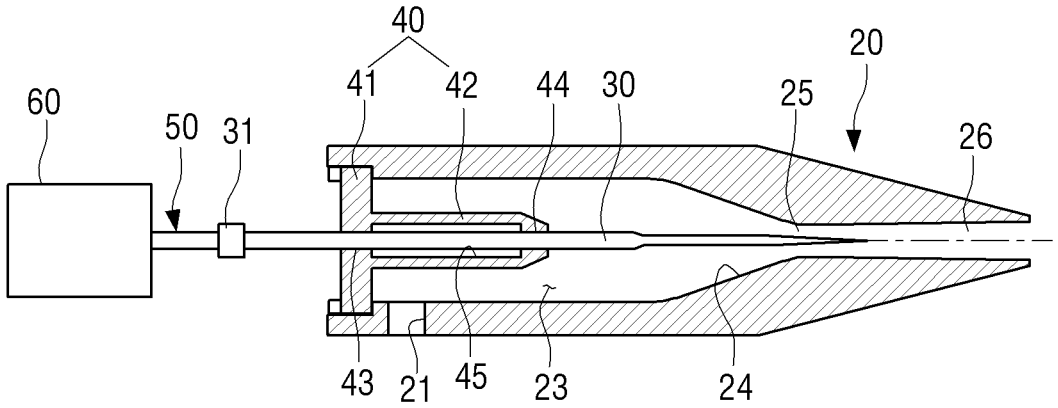
FIG. 16 is a graph illustrating test results of pressure increasing characteristics of a nozzle neck according to variation of load condition by an inner diameter of the nozzle neck in an air conditioning device according to an embodiment of the present disclosure.

An example of an opening degree adjusting device of a nozzle used in an ejector according to an embodiment of the present disclosure is illustrated in FIG. 16.

Referring to FIG. 16, an opening degree adjusting device 50 used in the ejector 1 (see FIG. 10) according to an embodiment of the present disclosure may include a needle 30, a needle guide member 40, and a driving part 60.

The needle 30 is disposed in the nozzle inlet portion 23 of the nozzle 20 and one end of the needle 30 is located at the nozzle neck 25 so that the needle 30 may control the flow rate of the refrigerant passing through the nozzle neck 25 according to the position of the needle 30. In other words, the needle 30 is disposed in the nozzle 20 to adjust the opening degree of the nozzle 20. Further, the needle 30 is provided with a stopper 31 for limiting the insertion depth of the needle 30. The stopper 31 is formed to have a diameter larger than an inner diameter of a through hole 43 of a base plate 41 to be described later.

The needle guide member 40 may include the base plate 41 provided at the rear end of the nozzle 20 and a protruding portion 42 protruding toward the nozzle neck 25 from the base plate 41. The base plate 41 serves to fix the needle guide member 40 to the nozzle 20 and supports the needle 30 to perform a slide movement to advance or retract relative to the nozzle neck 25. A first through hole 43 through which the needle 30 is inserted is formed in the center of the base plate 41. In addition, the protruding portion 42 is formed to support the needle 30 at two places together with the base plate 41. Accordingly, a second through hole 44 is formed at the center of the leading end of the protruding portion 42 to support the needle 30 so that the needle 30 can slidably move. Therefore, the needle 30 is supported at two points by the first through hole 43 of the base plate 41 and the second through hole 44 of the protruding portion 42 so that the needle 30 can be slidably moved with respect to the nozzle neck 25 in a stable manner. A space portion 45 is provided between the first through hole 43 of the base plate 41 and the second through hole 44 of the protruding portion 42 so that the needle 30 is not in contact with the protruding portion 42. Further, the needle guide member 40 is formed in a cylindrical shape so as not to interfere with the flow of the refrigerant introduced into the sub-inlet 21 and is formed to have a diameter smaller than the inner diameter of the nozzle inlet portion 23 of the nozzle 20.

The needle 30 is configured to be slidably moved by the driving part 60. The driving part 60 may include a driver and a power transmitter. The driver may use a motor such as a stepping motor, and the power transmitter may convert the rotational motion of the motor into a linear motion and transmit the linear motion to the needle 30. The power transmitter may have a rack structure or a screw structure.

In the case where the air conditioning device 100 includes two or more ejectors 1 and 2 as in the present disclosure, two or more needles 30 provided at two or more nozzles 20 provided in two or more ejectors 1 and 2 may be configured to be linearly moved by the respective driving parts 60. However, in the present embodiment, as illustrated in FIGS. 1, 3, 4, 6, and 8, two or more needles 30 are configured to be linearly moved by one driving part 60. Therefore, when the controller 101 controls the driving part 60, the two or more needles 30 provided in the two or more ejectors 1 and 2 simultaneously move linearly. However, since the air conditioning device 100 according to the present disclosure is configured so that the refrigerant flows through only one of the ejectors 1 and 2 depending on the load, when the driving part 60 drives the plurality of needles 30, the flow rate of the refrigerant flowing through the one ejector 1 or 2 may be controlled by the needle 30.

Figure 17:
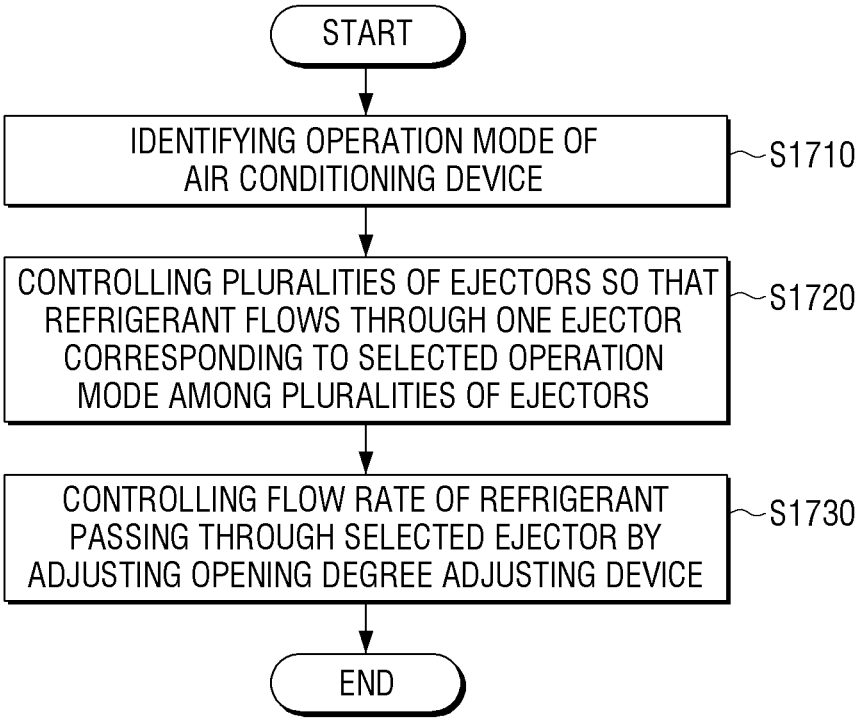
FIG. 17 is a flowchart illustrating a method for controlling an air conditioning device according to an embodiment of the present disclosure.

Hereinafter, a method for controlling the air conditioning device according to an embodiment of the present disclosure will be described with reference to FIG. 17.

The controller of the air conditioning device having the above-described plurality of ejectors identifies which of the plurality of operation modes is selected. For example, the controller identifies which of the plurality of operation modes, that is, the minimum mode operating at the minimum cooling load, the intermediate mode operating at the intermediate cooling load, and the maximum mode operating at the maximum cooling load, is selected as the operation condition of the air conditioning device (S1710).

Then, the controller causes the refrigerant to flow through one ejector corresponding to the selected operation mode among the plurality of ejectors according to the selected operation mode (S1720). At this time, the controller controls the refrigerant not to flow through the ejector other than the selected ejector. In detail, the controller turns on a valve disposed at the main inlet of the selected ejector and a valve disposed at the sub-inlet so that the refrigerant flowing out of the condenser and the evaporator is introduced into the ejector. In addition, the controller turns off valves disposed at the main inlet and the sub-inlet of the remaining unselected ejectors to block the refrigerant from entering the main inlet and the sub-inlet of the unselected ejector.

Then, the controller controls the opening degree adjusting device of the selected ejector to control the flow rate of the refrigerant passing through the selected ejector (S1730). As one example, the opening degree adjusting device may include a needle, a needle guide member, and a driving part as described above. The needle is disposed at the nozzle inlet portion of the nozzle, and one end of the needle is located at the nozzle neck so that the flow rate of the refrigerant passing through the nozzle neck may be adjusted depending on the position of the needle. The needle is configured to be slidably moved by the driving part. Accordingly, the controller may control the flow rate of the refrigerant passing through the ejector by controlling the driving part to control the position of the needle.

In the above description, the ejector according to an embodiment of the present disclosure is used in an air conditioning device using a plurality of ejectors. However, the ejector according to an embodiment of the present disclosure may be used for an air conditioning device using one ejector. At this time, the ejector may be formed to be optimized for one of the various operation conditions of the air conditioning device.

The invention claimed is:

1. An air conditioning device provided with a refrigerant circuit including a compressor, a condenser, and an evaporator, the air conditioning device comprising:

a plurality of ejectors connected in parallel to the refrigerant circuit, each of the plurality of ejectors formed to provide a different maximum flow rate from each of the other ejectors of the plurality of ejectors, the plurality of ejectors including:

a first ejector and a second ejector, a maximum refrigerant flow rate of refrigerant of the second ejector being greater than a maximum refrigerant flow rate of the first ejector, the first ejector being formed to control a flow rate of refrigerant passing through the first ejector, and the second ejector is formed to control the flow rate of refrigerant passing through the second ejector, a controller configured to control the plurality of ejectors, wherein when a cooling load of the air conditioning device is smaller than a cooling load corresponding to the maximum refrigerant flow rate of the first ejector, the controller controls a refrigerant to flow through the first ejector and not to flow through the second ejector, and the controller controls the flow rate of the refrigerant passing through the first ejector, and wherein when the cooling load of the air conditioning device is greater than the cooling load corresponding to the maximum refrigerant flow rate of the first ejector, the controller controls to block the refrigerant from flowing through the first ejector and to allow the refrigerant to flow through the second ejector, and the controller controls the flow rate of the refrigerant passing through the second ejector.

2. The air conditioning device of claim 1, wherein an ejector among the plurality of ejectors comprises:

an ejector body;

a nozzle disposed inside of the ejector body; and an opening degree adjusting device disposed in the nozzle and formed to adjust an opening degree of the nozzle.

3. The air conditioning device of claim 2, wherein the opening degree adjusting device includes a needle that is inserted in the nozzle and adjusts the opening degree of the nozzle, and wherein the needle inserted in the nozzle is among a plurality of needles disposed in the plurality of ejectors, respectively, and all the plurality of needles are operated by one driving part.

4. The air conditioning device of claim 3, wherein the opening degree adjusting device further includes a needle guide member, wherein the needle guide member includes a base plate provided at a rear end of the nozzle and a protruding portion protruding from the base plate, and wherein a through hole into which the needle is inserted is formed at a center of each of the base plate and the protruding portion.

5. The air conditioning device of claim 2, wherein the ejector body includes a main inlet and the nozzle includes a sub-inlet, and wherein the air conditioning device further comprises:

a main valve disposed between the condenser and the main inlet and configured to allow the refrigerant to enter the main inlet or to block the refrigerant from entering the main inlet; and a sub valve disposed between the evaporator and the sub-inlet and configured to allow the refrigerant to enter the sub-inlet or to block the refrigerant from entering the sub-inlet.

6. The air conditioning device of claim 2, wherein the nozzle forms a refrigerant passage along a longitudinal direction of the ejector body; and wherein the refrigerant passage comprises:

a nozzle inlet portion having a cylindrical shape;

a shrinkage portion having a truncated conical shape and converging in a moving direction of the refrigerant from the nozzle inlet portion;

a nozzle neck connected to the shrinkage portion and having a minimum inner diameter along the refrigerant passage formed inside the nozzle; and a nozzle diffuser portion having a truncated conical shape and diverging from the nozzle neck.

7. The air conditioning device of claim 6, wherein a shrinkage angle of the shrinkage portion is larger than a diffusion angle of the nozzle diffuser portion.

8. The air conditioning device of claim 6, wherein an inner diameter of the nozzle inlet portion is larger than an inner diameter of an outlet end of the nozzle diffuser portion.

9. The air conditioning device of claim 6, wherein a length of the nozzle diffuser portion is 10 to 50 times an inner diameter of the nozzle neck.

10. A method for controlling an air conditioning device provided with a plurality of ejectors, the method comprising:

identifying an operation mode selected among a plurality of operation modes of the air conditioning device; and controlling the plurality of ejectors depending on the selected operation mode, wherein the controlling controls refrigerant flow rates of the plurality of ejectors so that while refrigerant flows through one ejector among the plurality of ejectors at a first refrigerant flow rate corresponding to the selected operation mode among the plurality of operation modes another ejector among the plurality of ejectors is controlled to have a refrigerant flow at a second refrigerant flow rate different from the first refrigerant flow rate, wherein the plurality of ejectors includes a first ejector and a second ejector, and a maximum refrigerant flow rate of refrigerant of the second ejector is greater than a maximum refrigerant flow rate of the first ejector, wherein the first ejector is formed to control a flow rate of refrigerant passing through the first ejector, and the second ejector is formed to control the flow rate of refrigerant passing through the second ejector, wherein when a cooling load of the air conditioning device is smaller than a cooling load corresponding to the maximum refrigerant flow rate of the first ejector, the controlling controls a refrigerant to flow through the first ejector and not to flow through the second ejector, and the controlling controls the flow rate of the refrigerant passing through the first ejector, and wherein when the cooling load of the air conditioning device is greater than the cooling load corresponding to the maximum refrigerant flow rate of the first ejector, the controlling controls to block the refrigerant from flowing through the first ejector and to allow the refrigerant to flow through the second ejector, and the controlling controls the flow rate of the refrigerant passing through the second ejector.

11. The method of claim 10, further comprising:

controlling the flow rate of the refrigerant passing through a selected ejector by adjusting an opening degree adjusting device of the selected ejector.

12. The method of claim 10, the controlling of the plurality of ejectors depending on the selected operation mode comprising:

turning on or off valves disposed at a main inlet and a sub-inlet of each of the plurality of ejectors so that a refrigerant flows through one ejector corresponding to the selected operation mode among the plurality of ejectors and the refrigerant does not flow through a rest of the plurality of ejectors.

* * * * *